US010710866B2

(12) United States Patent
Zhu et al.

(10) Patent No.: US 10,710,866 B2
(45) Date of Patent: Jul. 14, 2020

(54) PRESSURIZED DECANTING DEVICE

(71) Applicant: Zake IP Holdings, LLC, South Bend, IN (US)

(72) Inventors: Jianqing Zhu, Granger, IN (US); Zhijun Yang, Shenzhen (CN); Fanxin Zeng, Dongguan (CN)

(73) Assignee: Zake IP Holdings, LLC, South Bend, IN (US)

( * ) Notice: Subject to any disclaimer, the term of this patent is extended or adjusted under 35 U.S.C. 154(b) by 0 days.

(21) Appl. No.: 15/480,665

(22) Filed: Apr. 6, 2017

(65) Prior Publication Data

US 2018/0290873 A1 Oct. 11, 2018

(51) Int. Cl.

| | |
|---|---|
| ***B67D 1/04*** | (2006.01) |
| ***B01F 3/04*** | (2006.01) |
| ***B01F 15/02*** | (2006.01) |

(52) U.S. Cl.

CPC ..... *B67D 1/0431* (2013.01); *B01F 3/04758* (2013.01); *B01F 15/0238* (2013.01); *B67D 1/0412* (2013.01); *B01F 2215/0072* (2013.01)

(58) Field of Classification Search

CPC .. B67D 1/0004; B67D 1/0431; B67D 1/0412; B67D 1/0425

See application file for complete search history.

(56) References Cited

U.S. PATENT DOCUMENTS

| | | | | |
|---|---|---|---|---|
| 4,174,743 | A * | 11/1979 | Beny | B67D 1/0431 137/212 |
| 2006/0124669 | A1* | 6/2006 | Wempe | A63B 55/00 222/192 |
| 2010/0005811 | A1* | 1/2010 | Jaffe | B67D 1/0869 62/3.64 |
| 2011/0036451 | A1* | 2/2011 | Maas | B67D 1/0431 141/2 |
| 2016/0354733 | A1* | 12/2016 | Chung | B67D 1/10 |
| 2018/0055263 | A1* | 3/2018 | Wu | A47J 43/04 |

* cited by examiner

*Primary Examiner* — J C Jacyna
(74) *Attorney, Agent, or Firm* — Botkin & Hall, LLP

(57) ABSTRACT

A pressurized decanting device decants wine, so that oxidation is prevented by not agitating the wine as it decants, or agitating solid matter resting on the bottom of bottle. The decanting device couples to the mouth of bottle through a cork having a cork borehole. A pump forces pressurized gas into the bottle of wine. The consequential pressure forces the wine out of the bottle through a discharge pipe in the housing. The device includes a base mounted with a housing. The housing includes an outlet apparatus, a pump, a power supply mechanism, and a switch mechanism operatively connected to the pump and the power supply mechanism. An outlet pipe and a gas guiding apparatus extend from the outlet apparatus. The switch mechanism mounts on the outlet apparatus through power supply mechanism. The outlet apparatus controls a liquid and a gas to discharge or stop discharging from outlet pipe.

9 Claims, 6 Drawing Sheets

PRESSURIZED DECANTING DEVICE

FIELD OF THE INVENTION

The present utility model relates to a pressurized decanting device, and more particularly to a decanting device for decanting wine so that oxidation is prevented by not agitating or mixing the wine as it decants, and so that substantially all of the wine in a bottle may be emptied therefrom without agitating the dregs and other solid matter that often rests on the bottom of the bottle; whereby the decanting device couples to the mouth, of the bottle; whereby a pump forces a pressurized gas into the bottle of wine; and whereby the consequential pressure forces the wine out of the bottle through a discharge pipe in the housing of the device; whereby when the wine is discharged from the outlet pipe, the wine mixes with a part of the inlet gas, which causes the gas and the wine to substantially mix and oxidized in the outlet pipe, so that this mixing function creates a unique decanting effect for the wine.

DESCRIPTION OF RELATED ART

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof to anything stated or implied therein or inferred thereupon.

At present, commercially available decanting devices have simple structures and are mostly funnel-shaped glass vessels. In a decanting process, red wine in a vessel cannot come into rapid and full contact with air. The decanting process requires dozens of minutes or an even longer time, resulting in great inconvenience in a practical process.

Typically, after a wine bottle is opened, wine is poured into a glass or a larger utensil and continuously shook, thus facilitating red wine to fully contact the oxygen in the air, causing carbolic acid to be oxidized, and achieving the objective removing sour and other miscellaneous taste produced due to long-term parking. The wine, after fully being oxidized, has better flavor and taste and can release intense aroma, thus having more mellow when it is drunk. However, during the whole decantation process, wine is always under the state of mild shaking, which requires to wait for a long period of time before decantation.

Other proposals have involved decanting wine directly from a bottle with minimal agitation and a nice oxidizing effect. The problem with these decanters is that they do not allow a pressurized gas and the wine to substantially mix and oxidized while dispensing. Also, the wine can be agitated during dispensing. Even though the above cited decanters meet some of the needs of the market, a pressurized decanting device enables a wine bottle to be emptied so that oxidation, is prevented by not agitating or mixing the wine as it decants, or agitating solid matter resting on the bottom of bottle.

SUMMARY

In view of this, the present utility model provides a pressurized decanting device that enables a wine bottle to be decanted, such that oxidation is prevented by not agitating or mixing the wine as it decants, or agitating dredge and solid matter resting on the bottom of the bottle.

The decanting device couples to the opening of a bottle neck through a cork having a cork borehole. The device comprises a pump that is controllable to force a pressurized gas into the cavity of the bottle. The consequential pressure from the gas pump forces a pressurized gas into the cavity of the bottle. The pressure build up forces the wine out of the bottle through a discharge pipe in the housing of the device. Thus, when the wine is discharged from the outlet pipe, the wine mixes with a part of the inlet gas, which causes the gas and the wine to substantially mix and oxidized in the outlet pipe. This mixing function creates a unique decanting effect for the wine.

In some embodiments, the pressurized decanting device may include a base that forms the structural integrity for the device. A housing mounts the base, substantially covering the base. The housing includes an outlet apparatus, a pump, and a power supply mechanism. A switch mechanism operatively connects to the pump and the power supply mechanism for control thereof. An outlet pipe and a gas guiding apparatus extend from the outlet apparatus. The switch mechanism mounts on the outlet apparatus through power supply mechanism. The outlet apparatus controls a liquid and a gas to discharge or stop discharging from outlet pipe.

By means of the foregoing technical solution, when the pressurized decanting device is mounted on a wine bottle, the switch mechanism is operated, and because the pump injects a gas into the wine bottle by using the gas guiding apparatus, air pressure inside the wine bottle becomes greater than external air pressure, so as to squeeze a liquid in the wine bottle and enable the liquid to flow out through the outlet pipe. In addition, when the liquid is discharged from the outlet pipe, the liquid is further mixed with a part of gas, making the gas and the liquid be fully mixed and oxidized in the outlet pipe, thereby achieving a decanting effect.

In some embodiments, a cork is disposed on the outlet apparatus. The cork forms a cavity. A borehole allows free and continuous passage between the cavity and the rest of the bottle to enable the liquid to discharge gas outside. The gas guiding apparatus includes a gas inlet pipe, a first vent pipe connected to the outlet pipe, and a second vent pipe connected to the cavity, the first vent pipe is connected to the second vent pipe through the switch mechanism, and the pump is connected to the cavity through the gas inlet pipe.

In some embodiments, the switch mechanism includes an electronic switch and a valve switch used to control the electronic switch to be connected or disconnected, the first vent pipe and the second vent pipe are respectively mounted on two sides of the valve switch, and the electronic switch is connected to the pump.

In some embodiments, the valve switch includes a valve body, a valve needle, and a button, a valve needle hole is disposed on the valve body, an end of the valve needle is mounted on the valve needle hole and controls the valve body to open or close, and the button is mounted at the other end of the valve needle.

In some embodiments, an elastic apparatus is included, where an end of the elastic apparatus is placed against the valve body, and the other end of the elastic apparatus is placed against the button and is mounted on the valve needle.

In some embodiments, the power supply mechanism includes a battery holder and a battery body mounted on the battery holder, a switch mounting groove is disposed on the battery holder, and the switch is mounted on the switch mounting groove.

In some embodiments, the base is a rigid cylindrical frame that supports a pump. The pump is used to compress and transport gas. The pump includes a motor, a vent pipe, a base floor, and the inlet and outlet valves collectively.

In some embodiments, a button is disposed on the housing, a snap button is disposed on the housing, and the housing is detachably connected to the housing by using the button and the snap button.

In some embodiments, the outlet pipe includes a discharge pipe located at an upper end of the liquid and a guiding pipe partially entering the liquid, and multiple gas guiding holes are disposed at a position where the guiding pipe and the discharge pipe are connected.

In some embodiments, a sealing thread is disposed on the cork.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
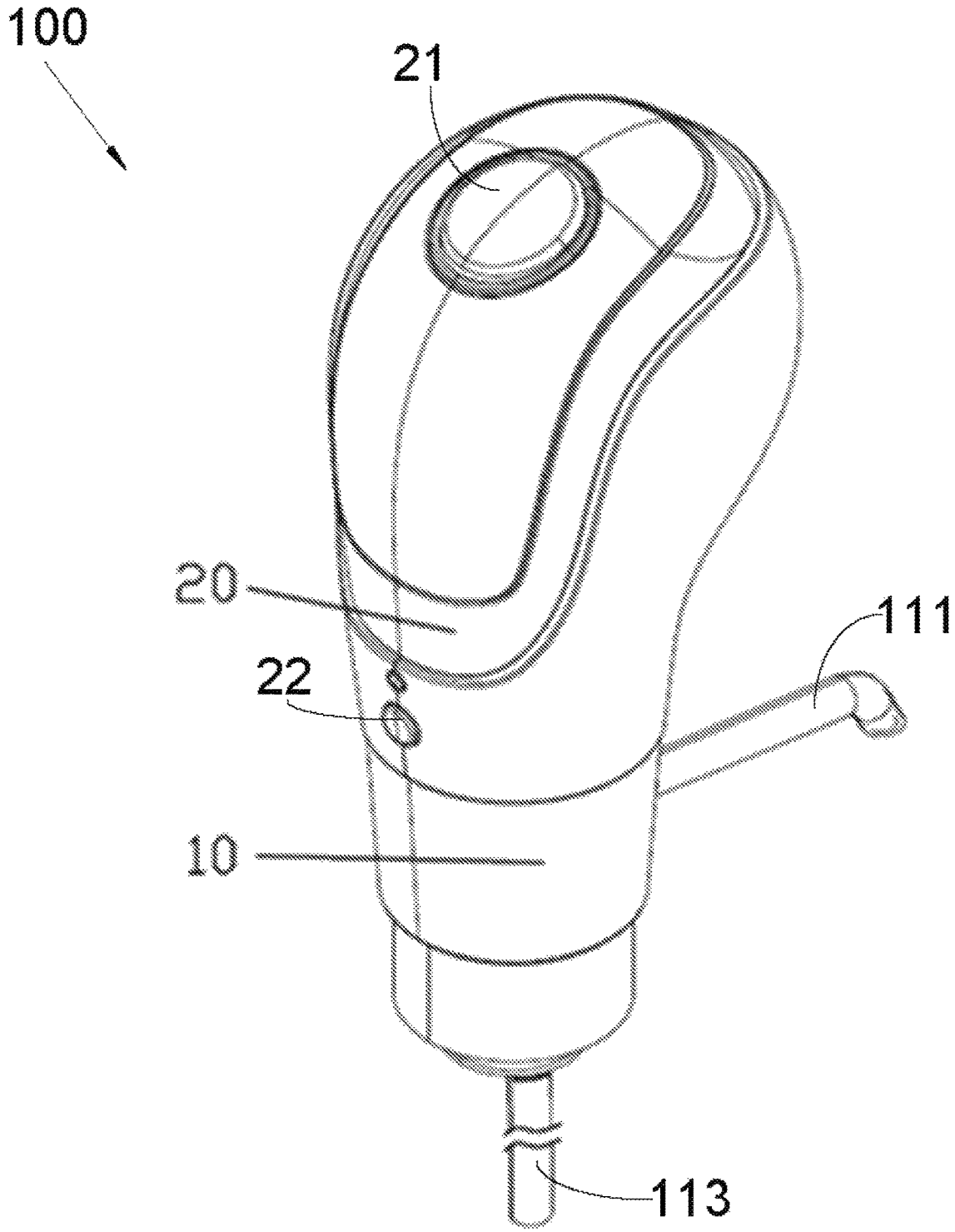
FIG. 1 is a schematic structural view of a pressurized decanting device provided in a preferred embodiment of the present utility model.

To make the objectives, technical solutions, and advantages of the present utility model more comprehensible, the present utility model is further illustrated in detail below with reference to the accompanying drawings and the embodiments. It should be understood that the described specific embodiments are only used to explain the present utility model rather than to limit the present utility model.

Referring to FIGS. 1-8, an embodiment of the present utility model provides a pressurized decanting device 100 for emptying a bottle (not shown) of wine, or other consumable liquid, with minimal oxygen contamination of the wine, or agitation of the wine contained in the bottle. The pressurized decanting device 100, hereafter "device 100" is also effective for mixing the wine with a pressurized gas to achieve oxidation upon dispensing, so as to provide an aerated, better tasting wine.

The device 100 is unique by providing 1) an alternative pumping mechanism; 2) a second air inlet to the spout assembly, which does alter the performance of the device by allowing additional fluid to leave the device at the moment of deactivation, at the cost of less precise measurement (Alters functionality slightly and is more energy efficient with dispensing fluid, but only negligibly); and 3) a lack of deliberate 'air ports'.

In some embodiments, the device 100 provides various switches and buttons that work to control a pump and valves for regulative discharge of pressurized gas into the bottle. The consequential pressure buildup in the bottle forces the wine to discharge through an outlet apparatus 11 for consumption. The wine mixes with the gas during discharge to provide an oxidation effect for an aerated wine.

In one possible embodiment, the device 100 is configured to be operatively coupled to a bottle or a similar container. The bottle may include, without limitation, wine, liquor, beer, fruit drinks, carbonated beverages, and dairy products. In any case, the device 100 operates in substantially the same manner to decant the contents of the bottle or container. In one embodiment, the bottle has a base, sidewalls that form a voluminous cavity, a neck that terminates at an opening. The device 100 couples to the bottle at the opening of the neck.

In one possible embodiment, the device 100 enables a wine bottle to be emptied so that oxidation is prevented by not agitating or mixing the wine as it decants, or agitating dredge and solid matter resting on the bottom of the bottle. The decanting device 100 couples to the mouth of bottle through a cork having a cork borehole. The device 100 comprises a pump that is controllable to force a pressurized gas into the cavity of the bottle. The consequential pressure from the gas forces the wine out of the bottle through a discharge pipe in the housing 20. Thus, when the wine is, discharged from the outlet pipe 111, the wine mixes with a part of the gas, which causes the gas and the wine to substantially mix and oxidized in the outlet pipe 111. This mixing function creates a unique decanting effect for the wine.

Figure 2:
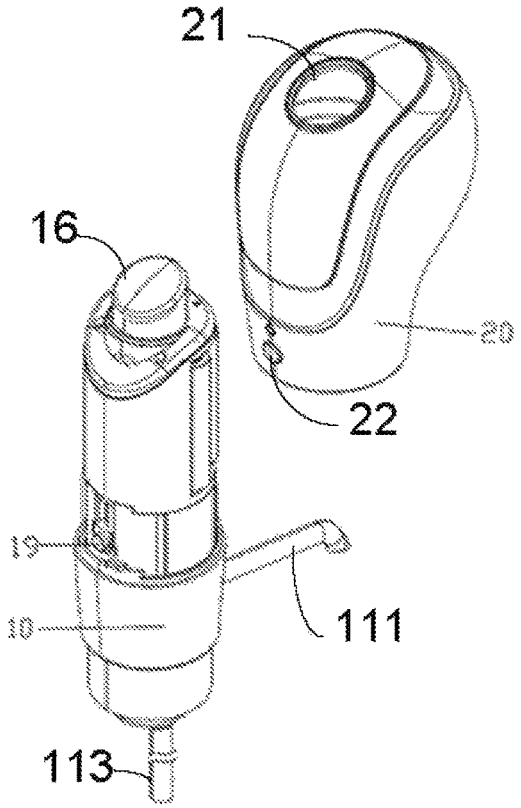
FIG. 2 is a schematic exploded view of the pressurized decanting device shown in FIG. 1, according to the present utility model.

Looking now at FIG. 2, the device 100 may include a base 10 that forms the framework for the device 100. A housing 20 detachably mounts on the base 10. The device 100 further comprises an outlet apparatus 11, a pump 194, a power supply mechanism 13, and a switch mechanism 14. An outlet pipe 111 and a gas guiding apparatus 17 are disposed on the outlet apparatus 11. The switch mechanism 14 is mounted on the outlet apparatus 11 by using the power supply mechanism 13. The outlet apparatus 11 controls, by using the pump 194, a liquid and a gas to discharge or stop discharging from the outlet pipe 111.

By means of the foregoing technical solution, when the device 100 is operational, the switch mechanism 14 is used to control the pump 194 for operation thereof. Because the outlet pipe 111 and the gas guiding apparatus 17 are disposed on the outlet apparatus 11, the pump 194 injects a gas into the bottle below the outlet apparatus 11 by using the gas guiding apparatus 17, making air pressure inside the bottle greater than air pressure outside the bottle. The wine and the gas in the bottle are subsequently discharged simultaneously, and in mixture, through the outlet pipe 111. In a discharging process, the wine and the gas are fully mixed and oxidized, thereby achieving a decanting effect.

Figure 3:
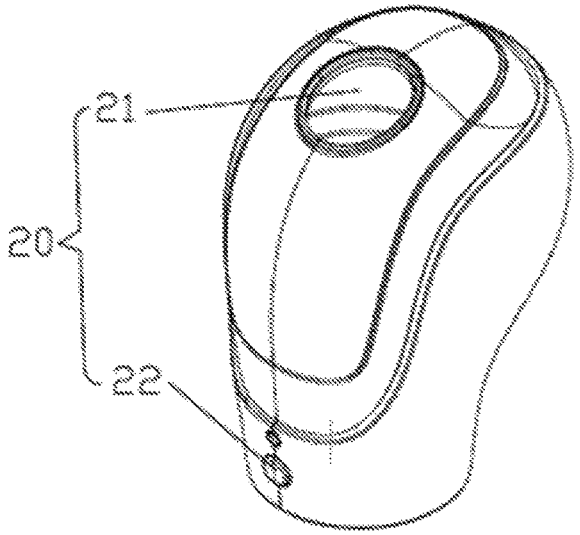
FIG. 3 is a schematic structural view of a housing shown in FIG. 1, according to the present utility model.

Referring to FIG. 3, in this embodiment, a housing button 22 and a housing through hole 21 are disposed on the housing 20. A snap button 19 is disposed on the housing 20. A position of the snap button 19 corresponds to a position of the housing button 22. When the housing 20 is mounted at the housing 20, the housing button 22 is clamped with the snap button 19, to fix the housing 20 at the housing 20. The housing button 22 is operated, to enable the housing button 22 to be separated from the snap button 19, so that the housing 20 can be removed from the housing 20. In addition, the switch mechanism 14 may be further operated by using the housing through hole 21, so as to operate the pump 194 more efficiently.

Figure 4:
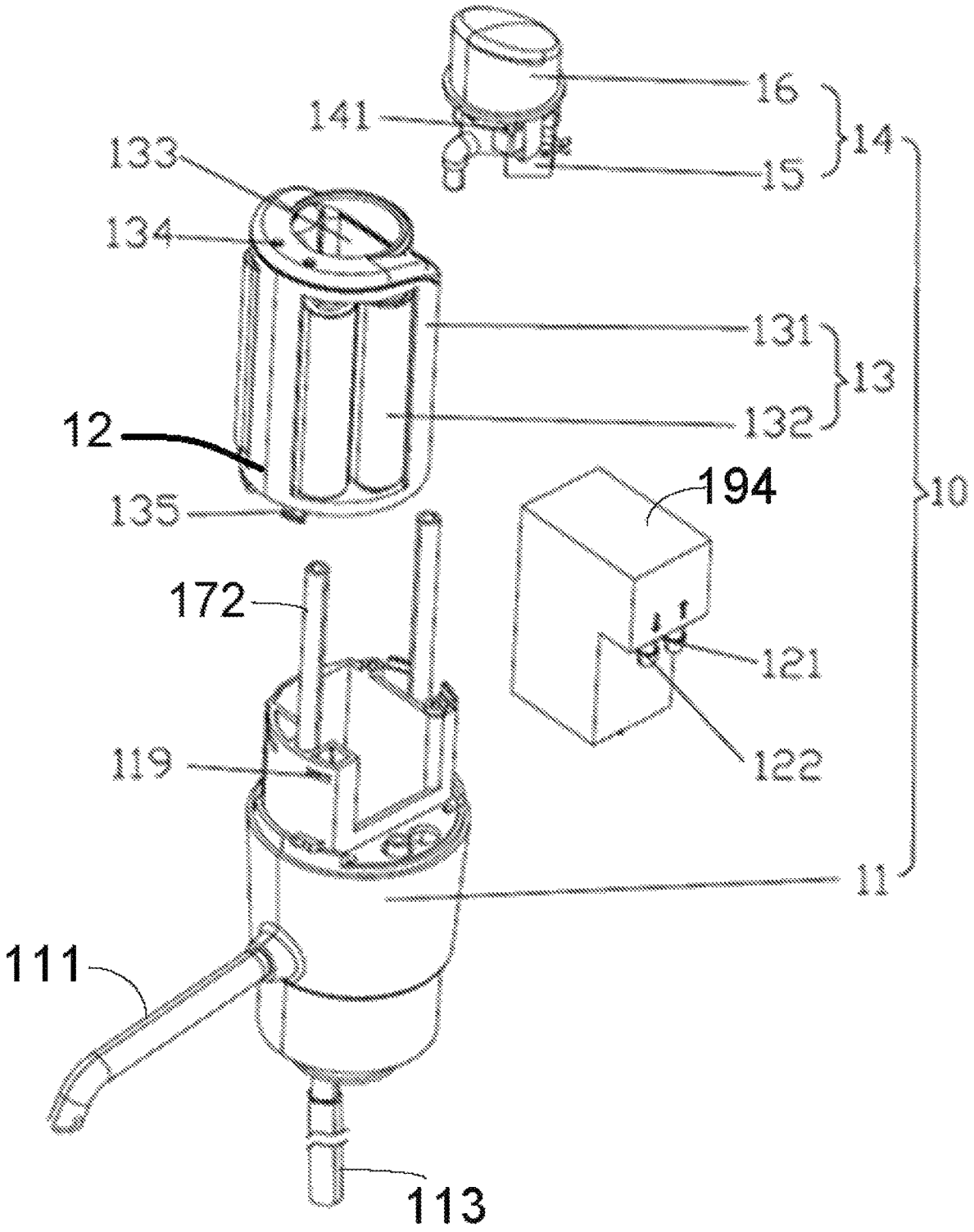
FIG. 4 is a schematic exploded view of a pump, including a motor, a vent pipe, a base floor, and the inlet and outlet valves collectively, according to the present utility model.
Figure 5:
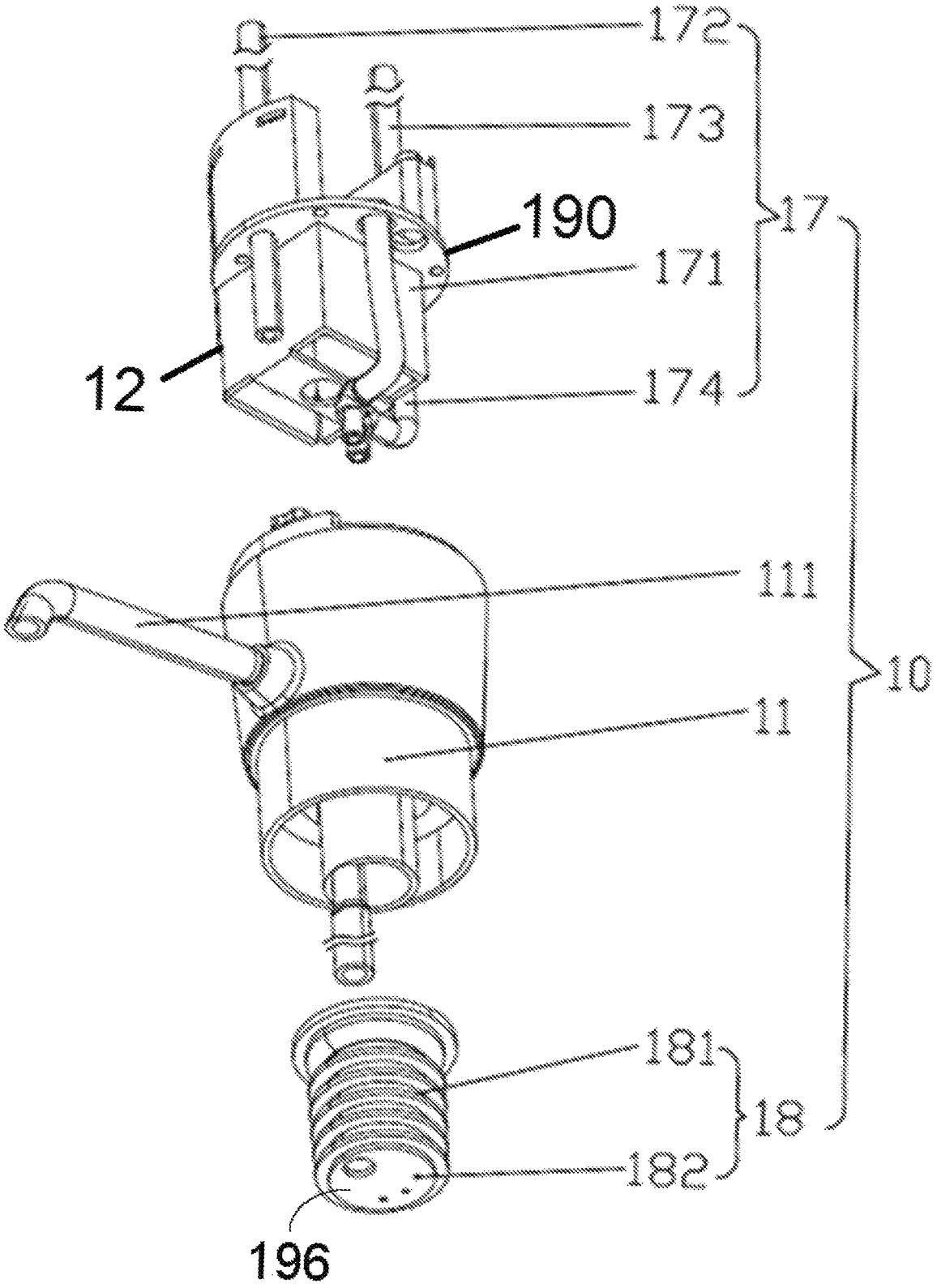
FIG. 5 is a bottom perspective view of FIG. 4, according to the present utility model.

As illustrated in the blow up view of FIG. 4, a power supply mechanism 13 powers the pump 194. The power supply mechanism 13 includes a battery holder 131 and a battery body 132. The battery body 132 is mounted on the battery holder 131. A switch mounting groove 133 and a support screw hole 134 are provided on the battery body 132. A switch screw hole 141 is disposed on the switch mechanism 14. The switch mechanism 14 is mounted at the switch mounting groove 133. The switch screw hole 141 is connected to the support screw hole 134 by using a screw or bolt.

By means of the foregoing technical solution, not only it becomes convenient to mount or detach the switch mechanism 14 and the power supply mechanism 13, which facilitates maintenance, but also an overall structure of the device 100 becomes more compact.

Looking now at FIG. 4, a support fastener 135 is disposed on the battery holder 131. A support clamping groove 119 is disposed on the outlet apparatus 11. The support fastener 135 is fastened and connected to the support clamping groove 119. By means of the foregoing technical solution, not only a mounting process is simplified and parts to use are reduced, but also detachment and mounting become convenient. At the same time, a fabrication cost is saved.

Figure 6:
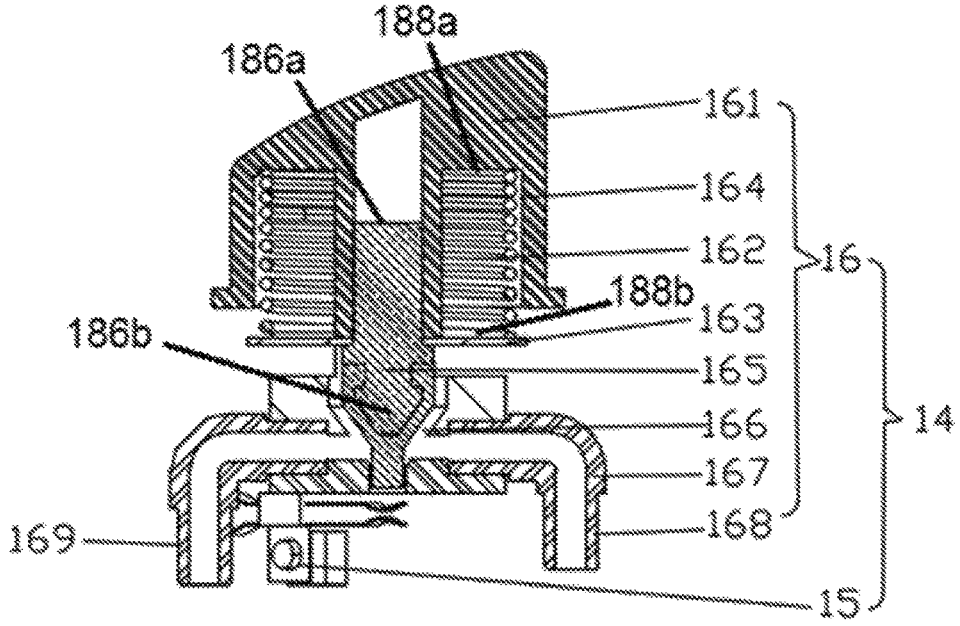
FIG. 6 is a schematic sectional view of a switch mechanism according to the present utility model.

Referring to the sectioned view of FIG. 6, the switch mechanism 14 includes an electronic switch 15 and a valve switch 16. In this embodiment, the electronic switch 15 is mounted below the valve switch 16. The valve switch 16 includes a valve body 167, a valve needle 165 defined by a pair of needle ends 186*a*, 186*b*, and a button 161. A valve needle hole 166 that penetrates two ends of the valve body 167 is opened on the valve body 167. One end 186*a* of the valve needle 165 passes through the valve needle hole 166 and then controls the electronic switch 15 to be connected or disconnected. The other needle end 186*b* is connected to the button 161.

Thus, by means of the foregoing technical solution, when the button 161 is operated to control the valve switch 16 to be connected or disconnected, the electronic switch 15 at the same time implements, connection or disconnection. Under the control of double switches, a decanting effect of the decanting device is improved.

Looking again at FIG. 6, two ends of the valve body 167 are respectively disposed at connecting ends 168 and 169. The gas guiding apparatus 17 includes a gas guiding mounting seat 171, a first vent pipe 172, a second vent pipe 173, and a gas inlet pipe 174. The first vent pipe 172, the second vent pipe 173, and the gas inlet pipe 174 are all mounted on the gas guiding mounting, seat 171.

A cork 18 is further disposed on the outlet apparatus 11. The cork 18 has a cavity 184, a cork borehole 182 through which a gas in the cavity 184 flows out, and an outlet pipe through hole 183 for mounting the outlet pipe 111 are provided on the cork 18. In this embodiment, an end of the first vent pipe 172 and an end of the second vent pipe 173 are respectively mounted on the connecting end 168 and the connecting end 169. The other end of the first vent pipe 172 and the other end of the second vent pipe 173 are respectively connected to the outlet pipe 111 and the cavity 184.

One end of the gas inlet pipe 174 is disposed in the cavity 184. The other end of the gas inlet pipe 174 is connected to the pump 194. When the switch mechanism 14 is closed, the valve needle 165 passes through the valve needle hole 166 to enable the electronic switch 15 to be closed. The first vent pipe 172 and the second vent pipe 173 share an opening, but are not otherwise connected any more than any other two openings. That is, the cavity 184 is isolated from outside.

The pump 194 compresses and transports a gas. The gas enters the cavity 184 before passing into the bottle. Air pressure inside the cavity 184 is greater than external air pressure, to enable the gas to apply a pressure on the liquid in a wine bottle by using the cork borehole 182, so that the liquid flows along the outlet pipe 111 and discharges outside.

Figure 7:
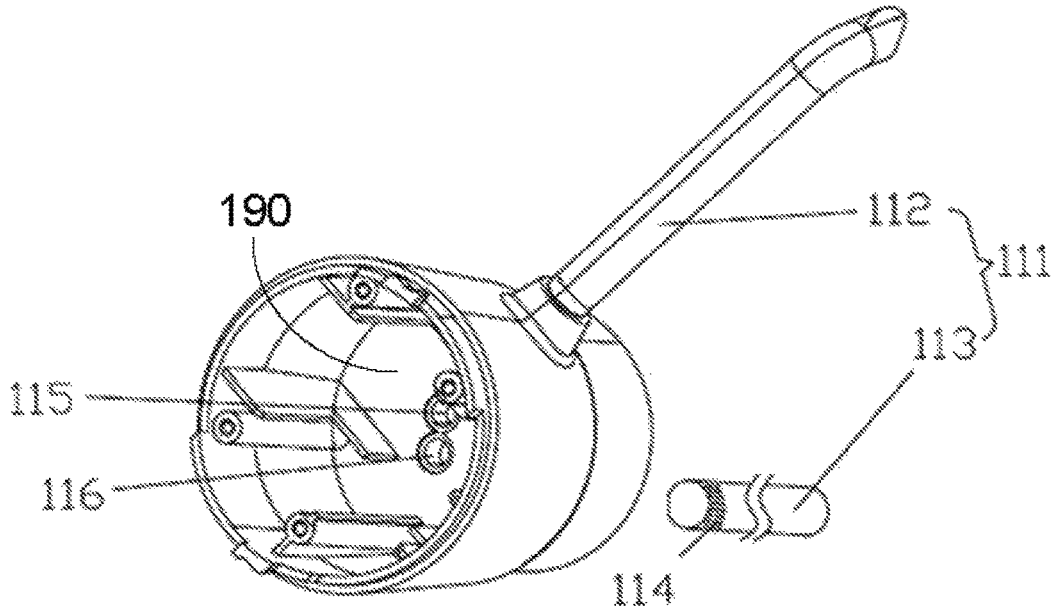
FIG. 7 is a partial schematic structural view of an outlet apparatus according to the present utility model.

Referring to FIG. 7, the switch mechanism 14 further includes an elastic apparatus 162 defined by a pair of elastic ends 188*a*, 188*b*. The elastic apparatus 162 may be made of any elastic material such as a spring and a rubber band. In this embodiment, the elastic apparatus 162 is a spring. A plate 163 is disposed on the valve needle 165. A button recess 164 is opened on the button 161. The elastic apparatus 162 is mounted on the button recess 164. One end 188*a* of the elastic apparatus 162 is placed against the plate 163. The other elastic end 188*b* of the elastic apparatus 162 is placed against the button 161. By means of the foregoing technical solution, not only the button 161 keeps an elastic effect, but also it is ensured that the switch mechanism 14 can be automatically restored.

In some embodiments, the base 10 is a rigid cylindrical frame that supports a pump 194. The pump 194 is used to compress and transport gas. The pump 194 includes a motor 12, a vent pipe 172, a rigid base floor 190, and the inlet and, outlet valves 121, 122 collectively. In this embodiment, an inlet valve 121 and an outlet valve 122 are disposed on the pump 194. The inlet valve 121 is connected to the outside by using the housing 20. The outlet valve 122 is connected to the gas inlet pipe 174. During the rotation of the motor 12, the vent pipe 172 is driven to swing.

The pump 194 sucks in a gas by using the inlet valve 121. The pump 194 squeezes the gas out by using the outlet valve 122, and the gas enters the cavity 184. By means of the foregoing technical solution, because the base floor divides the pump 194 into two parts, in a process in which the pump 194 transfers, sucks, and compresses the gas, auxiliary lubrication of oil is not required.

In some embodiments, a diaphragm 196 is further included. The diaphragm 196 is mounted across the cavity 184. In this embodiment, a diameter of the cork borehole 182 sequentially decreases from the outer side of the cork 18 towards the cavity 184. By means of the foregoing technical solution, when a wine bottle is inclined or is placed horizontally, because a diaphragm is provided above the liquid, the liquid is prevented from the cavity 184 through the cork through a cork borehole 182.

Moreover, the diaphragm 196 is disposed over the cavity 184, so as to prevent one more time the liquid from entering the cavity 184 through the cork borehole 182. The bore hole 182 forms in the diaphragm 196 and is means by which liquid would bypass the diaphragm 196. The diaphragm 196 does not limit flow through the boreholes, merely defines where the boreholes are not.

Referring to FIG. 7, a gas inlet pipe interface 115 and a second vent pipe interface 116 are further disposed on the housing 20. The gas inlet pipe 174 and the second vent pipe 173 are respectively connected to the gas inlet pipe interface 115 and the second vent pipe interface 116. The cavity 184 is mounted below the gas inlet pipe interface 115 and the second vent pipe interface 116. In this embodiment, the outlet pipe 111 includes a discharge pipe 112 located at an upper end of the liquid and a guiding pipe 113 partially entering the liquid. A vent pipe interface is disposed on the discharge pipe 112. The first vent pipe 172 is connected to the vent pipe interface.

In some embodiments, multiple gas guiding holes 114 form at a position where the guiding pipe 113 and the discharge pipe 112 are connected. By means of the foregoing technical solution, when the pump 194 is working, a gas squeezes a liquid in a wine bottle by using the cavity 184, to enable the liquid to enter the discharge pipe 112 together with the gas that enters through the gas guiding holes 114. After the gas and the liquid are fully mixed and oxidized in the discharge pipe 112, the gas and liquid are discharged outside, thereby implementing a decanting function of the decanting device.

Figure 8:
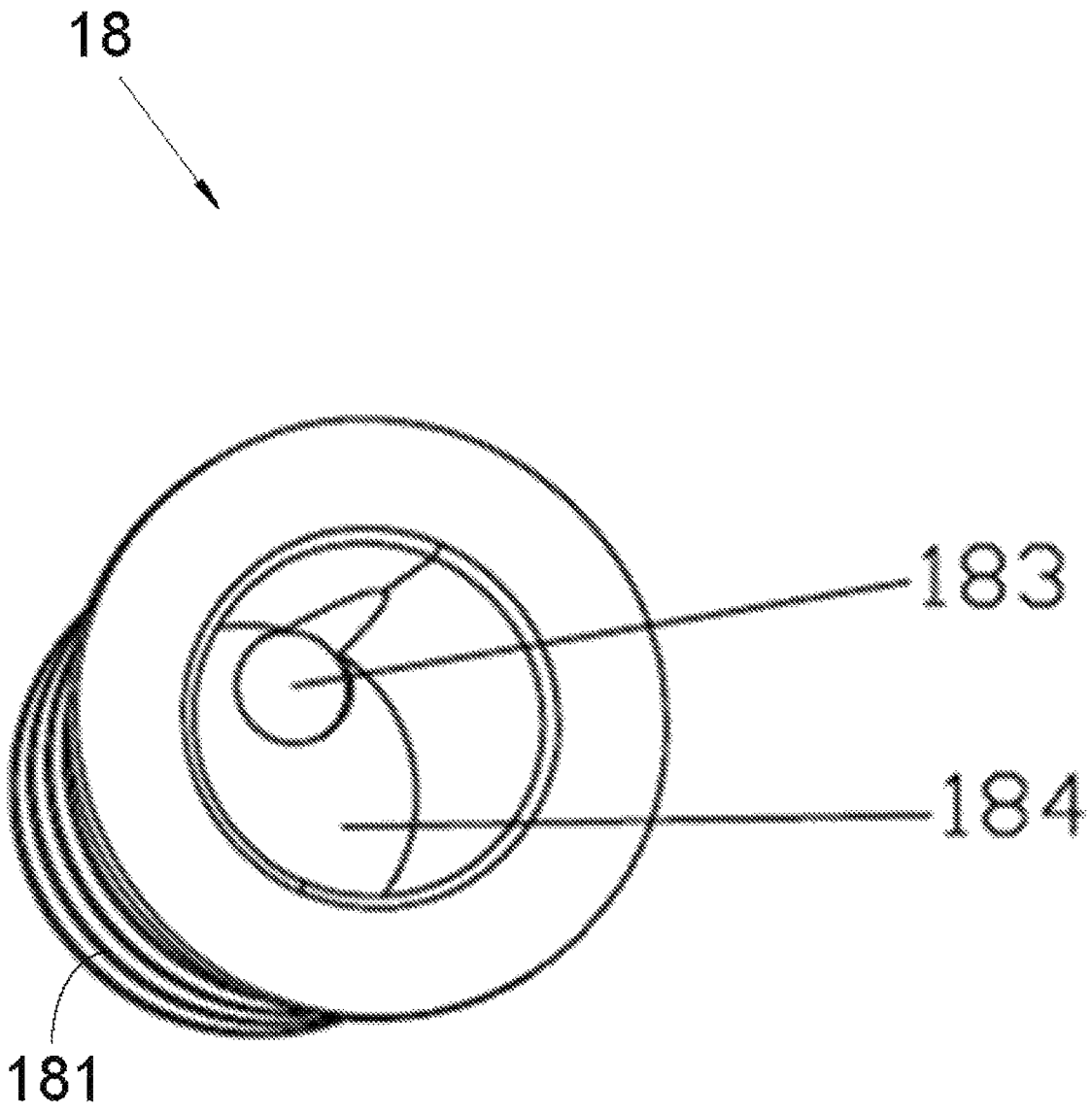
FIG. 8 is a schematic structural view of a cork according to the present utility model.

Finally, looking at FIG. 8, a cork 18 is sized and dimensioned to couple with the opening in the neck of the bottle in a friction fit relationship. The cork 18 comprises a cork borehole 182 and a sealing thread 181 is disposed on the cork 18. The sealing thread 181 rotatably engages an inner surface of the neck of the bottle by rotating in a first or second direction while urging the cork 18 into the neck of the bottle, so that a sealing ring can be provided between the device 100 and the bottle, creating a seal, and thereby ensuring air pressure inside the bottle. This pressurization effect works to facilitate discharge of the wine from inside the bottle in an oxidized, decanted state.

These and other advantages of the invention will be further understood and appreciated by those skilled in the art by reference to the following written specification, claims and appended drawings. The foregoing is merely preferred embodiments of the present, utility model but is not used to limit the present utility model. Any changes, equivalent replacements, and improvements made within the spirit and principle of the present utility model shall fall within the protection scope of the present utility model.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A pressurized decanting device, the device comprising:

a base;

a housing configured to at least partially mount the base;

an outlet apparatus extending from the base, the outlet apparatus comprising an outlet pipe;

a pump configured to compress and transport a gas;

a power supply mechanism;

a gas guiding apparatus in communication with the pump and the outlet apparatus, the gas guiding apparatus comprising a gas inlet pipe in communication with the pump;

a switch mechanism being mounted on the outlet apparatus, the switch mechanism configured to power on and off the pump in a circuitry arrangement, whereby powering on the pump through operation of the switch mechanism forces the gas through the gas inlet pipe; and a cork defined by a sealing thread and a cavity, the cork configured to detachably couple to the outlet apparatus; and a diaphragm disposed across the cavity, the diaphragm forming a cork borehole configured to enable passage of the gas, wherein the gas guiding apparatus comprises a gas inlet pipe, a first vent pipe connected to the outlet pipe, and a second vent pipe in communication with the cavity, the first vent pipe being connected to the second vent pipe through the switch mechanism, and the pump being in communication with the cavity through the gas inlet pipe.

2. The device of claim 1, wherein the switch mechanism comprises an electronic switch and a valve switch configured to operatively connect and disconnect the electronic switch, the electronic switch further being operatively connected to the pump, whereby the first vent pipe and the second vent pipe are respectively mounted on two sides of the valve switch.

3. The device of claim 2, wherein the valve switch comprises a valve body, a button, and a valve needle defined by a pair of needle ends and a valve needle hole, whereby one of the needle ends is mounted on the valve needle hole and controls the valve body to open and close, whereby the button is mounted at the other needle end of the valve needle.

4. The device of claim 3, further comprising an elastic apparatus defined by a pair of elastic ends, wherein one elastic end of the elastic apparatus is placed against the valve body, and an opposite elastic end of the elastic apparatus is placed against the button and mounted on the valve needle.

5. The device of claim 4, wherein the power supply mechanism comprises a battery holder and a battery body mounted on the battery holder, whereby a switch mounting groove is disposed on the battery holder.

6. The device of claim 5, wherein the pump includes a motor, a vent pipe, a base floor, an inlet valve, and an outlet valve.

7. The device of claim 6, further comprising a housing button disposed on the housing and a snap button disposed on the housing, whereby the housing is detachably connected to the base through manipulation of the housing button and the snap button.

8. The device of claim 7, wherein the outlet pipe comprises a discharge pipe, a guiding pipe, and multiple gas guiding holes forming where the guiding pipe and the discharge pipe are connected.

9. A pressurized decanting device, the device consisting of;

a base;

a housing configured to at least partially mount the base;

an outlet apparatus extending from the base, the outlet apparatus comprising an outlet pipe, the outlet pipe comprising a discharge pipe, a guiding pipe, and multiple gas guiding holes forming where the guiding pipe and the discharge pipe are connected;

a cork defined by a sealing thread and a cavity, the cork configured to detachably couple to the outlet apparatus;

a diaphragm disposed across the cavity, the diaphragm forming a cork borehole configured to enable passage of the gas;

a pump configured to compress and transport a gas, the pump comprising a motor, a vent pipe, a base floor, an inlet valve, and an outlet valve;

a power supply mechanism;

a gas guiding apparatus in communication with the pump and the outlet apparatus, the gas guiding apparatus comprising a gas inlet pipe in communication with the pump, a first vent pipe connected to the outlet pipe;

a second vent pipe in communication with the cavity, whereby the first vent pipe is connected to the second vent pipe through a switch mechanism, and the pump being in communication with the cavity through the gas inlet pipe, the switch mechanism being mounted on the outlet apparatus, the switch mechanism configured to power on and off the pump in a circuitry arrangement, whereby the switch mechanism comprises an electronic switch and a valve switch configured to operatively connect and disconnect the electronic switch, the electronic switch further being operatively connected to the pump, whereby the first vent pipe and the second vent pipe are respectively mounted on two sides of the valve switch, whereby powering on the pump through operation of the switch mechanism forces the gas through the gas inlet pipe;

a housing button disposed on the housing; and a snap button disposed on the housing, whereby the housing is detachably connected to the base through manipulation of the housing button and the snap button.

* * * * *